US009053896B2

(12) United States Patent
Freudenberger et al.

(10) Patent No.: US 9,053,896 B2
(45) Date of Patent: Jun. 9, 2015

(54) FOCAL TRACK OF A ROTATING ANODE HAVING A MICROSTRUCTURE

(75) Inventors: Jörg Freudenberger, Kalchreuth (DE); Stefan Lampenscherf, Poing (DE); Wolfgang Schäff, Erlangen (DE); Steffen Walter, Oberpframmern (DE)

(73) Assignee: Siemens Aktiengesellschaft, München (DE)

( * ) Notice: Subject to any disclaimer, the term of this patent is extended or adjusted under 35 U.S.C. 154(b) by 399 days.

(21) Appl. No.: 13/538,543

(22) Filed: Jun. 29, 2012

(65) Prior Publication Data

US 2013/0170624 A1 Jul. 4, 2013

(30) Foreign Application Priority Data

Jul. 1, 2011 (DE) ..... 10 2011 078 520

(51) Int. Cl.
*H01J 35/10* (2006.01)

(52) U.S. Cl.
CPC ..... *H01J 35/10* (2013.01); *H01J 2235/081* (2013.01); *H01J 2235/085* (2013.01); *H01J 2235/086* (2013.01)

(58) Field of Classification Search
CPC ..... H01J 35/10; H01J 2235/081; H01J 2235/085; H01J 2235/086
USPC ..... 378/144
See application file for complete search history.

(56) References Cited

U.S. PATENT DOCUMENTS

| | | | | |
|---|---|---|---|---|
| 7,079,625 | B2 | 7/2006 | Lenz | |
| 7,356,122 | B2 | 4/2008 | Raber et al. | |
| 2004/0208288 | A1 * | 10/2004 | Lenz | 378/121 |
| 2007/0269015 | A1 * | 11/2007 | Raber et al. | 378/144 |

FOREIGN PATENT DOCUMENTS

DE 103 60 018 A1 7/2004

OTHER PUBLICATIONS

Madou, Marc J., Fundamentals of Microfabrication: The Science of Miniaturization, Second Edition, (Mar. 13, 2002), pp. 97-105.*

* cited by examiner

*Primary Examiner* — Glen Kao
(74) *Attorney, Agent, or Firm* — Lempia Summerfield Katz LLC

(57) ABSTRACT

A rotating anode includes a focal track that has a microstructure on a surface of the focal track. The microstructure is produced using deep reactive ion etching.

20 Claims, 3 Drawing Sheets

FOCAL TRACK OF A ROTATING ANODE HAVING A MICROSTRUCTURE

This application claims the benefit of DE 10 2011 078 520.5, filed on Jul. 1, 2011.

BACKGROUND

The present embodiments relate to a rotating anode having a microstructure on a surface of a focal track.

A focal track containing, for example, tungsten is subjected to high levels of thermal stress while X-radiation is being produced for medical applications by a rotating anode. Temperatures of over 2,500° C. may be reached on the focal track during the creation of X-radiation (where high-energy electrons are slowed down by the focal track, and the X-radiation is produced by bremsstrahlung ("braking radiation")). The high temperatures may cause premature aging of the focal track. Focal tracks that have undergone aging exhibit substantial cracking and exaggerated grain growth due to recrystallizing of the tungsten structure, with an X-radiation dose rate decreasing as cracking increases. Cracking may be explained by high levels of cyclic temperature stress (e.g., in the case of a rotating anode having typical frequencies of between 100 and 200 Hz) causing the recrystallized tungsten structure to shatter when subjected to fast sequences of tensile and compressive stress. The tungsten structure may shatter to the extent that even whole grains or regions drop out of the focal track, which further reduces the dose rate. The rotating anode will then have to undergo maintenance.

To extend the life of tungsten focal tracks, oxide dispersed strengthening (ODS) or vacuum plasma spraying (VAS) methods that alter the microstructure of tungsten positively may be used.

U.S. Pat. No. 7,356,122 describes an X-ray anode having a thermally-compliant focal-track region for impingement of electrons from an X-ray cathode for producing X-radiation. The thermally-compliant focal-track region has a surface structure of discrete elevations and depressions. The elevations have dimensions of 50 micrometers to 500 micrometers. The depressions have a depth of 10 micrometers to 20 micrometers and a width of 3 micrometers to 20 micrometers.

DE 103 60 018 A1 discloses an X-ray anode having a highly thermally stressable surface with defined microslits being arranged in the relevant surface. The microslits are produced by removing material using a laser beam or high-pressure water jet. An angle of the jet or beam direction is varied relative to a slit base for widening the microslit.

SUMMARY AND DESCRIPTION

The present embodiments may obviate one or more of the drawbacks or limitations in the related art. For example, an improved rotating X-ray anode is provided.

In one embodiment, a rotating (X-ray) anode having a focal track has a microstructure on a surface of the focal track. The microstructure is produced using deep reactive ion etching (DRIE)

Deep reactive ion etching makes it possible to produce deeper and narrower structures (e.g., deeper structures for reducing stresses and narrower structures for maintaining a large X-ray-active surface) in a focal track (e.g., a focal track containing tungsten (or an alloy of tungsten)). Compared with removing material using a laser beam and, for example, a water jet, deep reactive ion etching offers the advantages of highly accurate structuring (e.g., low fabrication tolerances) and a high degree of edge steepness even with large aspect ratios and narrow structure widths.

In one embodiment, the microstructure has a depth of at least approximately 40 micrometers. Cracks leading to a substantially reduced dose rate for the rotating anodes and even causing the focal track to fail may still occur in the base of the microstructure in the case of a microstructure that is flatter than approximately 40 micrometers (e.g., between 10 and 20 micrometers). The present depth of at least approximately 40 micrometers, by contrast, allows the stress on the material of the focal track to be sufficiently relieved down to the base of the microstructure, owing to the free lateral surfaces produced by the microstructure. A rotating anode having a longer life than previously may thus be provided. The rotating anode therefore offers the advantage of being able to effectively suppress cracking of the surface of the rotating anode due to an alternating thermal load during operation.

In one embodiment, the microstructure has a depth of at least approximately 50 micrometers. Thus, for example, enhanced reliability may be achieved in the suppression of cracking because account may be taken of fabrication tolerances (e.g., in producing the microstructure).

In one embodiment, the microstructure has a depth of up to approximately 150 micrometers (e.g., up to approximately 100 micrometers). The depth enables cracking to be particularly effectively suppressed.

In yet another embodiment, the microstructure has at least one trench or slit. This embodiment enables a particularly long and relatively easy-to-produce microstructure to be provided. Also made possible thereby is a well-defined stress distribution in the surface of the focal track. Further made possible by the trench is effective stress relief in the focal track with relatively little surface loss and hence a relatively little reduced dose rate. The majority of the surface that remains will be substantially unaffected by the microstructure as regards production of the X-radiation.

In a further embodiment, the microstructure (e.g., the at least one trench) has a width of between 2 micrometers and 15 micrometers (e.g., between 3 micrometers and 10 micrometers or between 5 micrometers and 10 micrometers). The result is a particularly advantageous compromise between relieving the stress on the material of the focal track and there being little impact on the dose rate due to surface loss.

In another embodiment, the microstructure has a plurality of trenches arranged in a lattice-like pattern. A large surface may thereby, in a simple manner, be effectively relieved of stress under an alternating thermal load. The remaining, non-structured surface has a checkered pattern.

In another embodiment, a distance between adjacent, substantially mutually parallel trenches is between approximately 100 micrometers and approximately 300 micrometers. This will likewise enable a high dose rate to be maintained.

In a further embodiment, a ratio between a width of a trench and a distance from an adjacent, substantially parallel trench is at least 0.1. This too enables a high dose rate to be maintained.

In yet another embodiment, the focal track contains tungsten. The focal track may include substantially pure tungsten or an alloy of tungsten (e.g., a rhenium-tungsten alloy containing approximately 5% to approximately 10% rhenium). The focal track may be, for example, 1 mm thick.

In one embodiment, an X-ray device (e.g., for medical applications) including at least one rotating anode, as described above, is provided. The X-ray device displays the same advantages as the above-described rotating anode and may also be embodied analogously.

In another embodiment, a method for producing a rotating anode is provided. The method includes incorporating a microstructure in a surface of a focal track of the rotating anode using deep reactive ion etching.

BRIEF DESCRIPTION OF THE DRAWINGS

Elements that are the same or function in the same way may be assigned the same reference numerals for the sake of clarity.

DETAILED DESCRIPTION OF THE DRAWINGS

Figure 1:
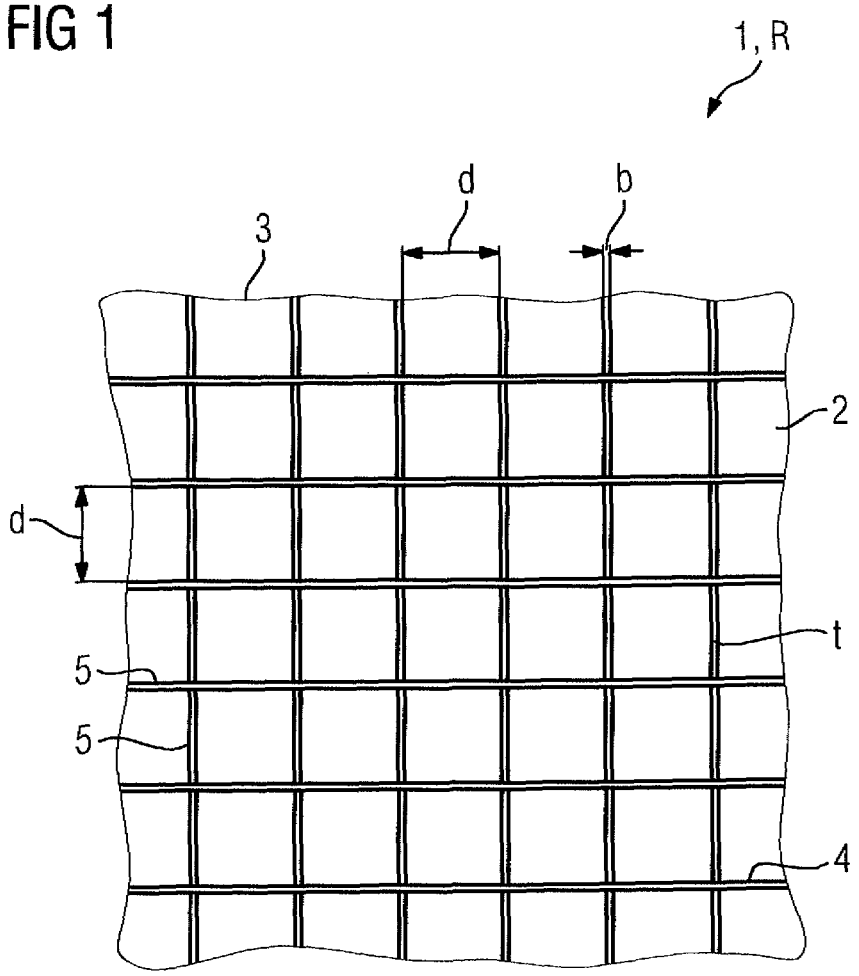
FIG. 1 is a top view of a section of a surface having a microstructure of a focal track of one embodiment of a rotating anode for an X-ray device for medical purposes.

FIG. 1 is a top view of a section of a rotating anode 1 of an X-ray device R for medical purposes. FIG. 1 shows a surface 2 (e.g., a free surface) of a focal track 3, on which a focal spot of an electron beam is produced. The focal track 3 is a tungsten-rhenium alloy having a depth (e.g., perpendicularly into the image plane) of approximately 1 mm.

The surface 2 of the focal track 3 has a microstructure 4 in the form of rectilinear slits or trenches 5 provided in a rectangular lattice-like manner. The remaining, non-structured surface 2 of the focal track 3 is embodied in a checkered manner. Each of the trenches 5 has a depth t (e.g., perpendicularly into the image plane) of between 50 micrometers and 100 micrometers.

The trenches 5 each have a width b of between 5 micrometers and 10 micrometers in order to achieve a good compromise between a crack-inhibiting relief of stress on the non-structured surface 2 and low surface loss on account of the microstructure 4. For the same purpose, a distance d between adjacent, parallel trenches 5 is between, for example, approximately 100 micrometers and 300 micrometers. A ratio of the width b of trenches 5 to the distance d to an adjacent, parallel trench 5 is consequently at least 0.1.

The trenches 5 may, for example, be produced using deep reactive ion etching. FIGS. 2 to 7 are lateral sectional views of a sequence of deep-reactive-ion-etching operations for producing the trenches 5. Deep reactive ion etching is an alternating dry-etching process, in which etching and passivation steps alternate. The aim is to etch as anisotropically perpendicular as possible to the surface 2 of the focal track 3. Very narrow trenches 5 may be etched in this way.

Figure 2:
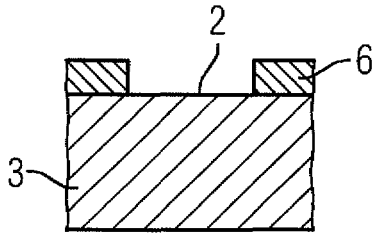
FIGS. 2-7 are lateral sectional views of a sequence of deep-reactive-ion-etching operations for producing the microstructure.

As shown in FIG. 2, the surface 2 of the focal track 3 made of tungsten (e.g., including a tungsten alloy) is covered with, for example, a photolithographically produced mask 6. The mask 6 may include, for example, photoresist or aluminum. The mask 6 covers parts of the focal track 3 not requiring to be structured. The actual etching process then commences.

For example, tetrafluoromethane ($CF_4$) in a carrier gas (e.g., argon) is introduced into a reactor, in which focal track 3 is located. The production of an energy-rich high-frequency plasma causes a reactive gas to form from the $CF_4$. Together with an accelerating of ions in an electric field, overlapping occurs between a chemical (e.g., isotropic) etching reaction (e.g., due to radicals formed from $CF_4$) on the exposed tungsten and a physical (e.g., anisotropic) removal of material (e.g., due to sputtering by argon ions). This is shown in FIG. 3.

Figure 4:
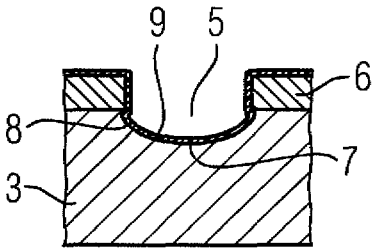

As shown in FIG. 4, the etching process is stopped after a short period of time, and a gas mixture consisting of octafluorocyclobutane ($C_4F_8$) and argon is introduced as the carrier gas. Octafluorocyclobutane is activated in the reactor's plasma and forms a polymer-passivation layer 9 on the whole of the focal track 3 (e.g., on the mask 6, on a floor 7, and on vertical side walls 8 of the trench 5). The vertical side walls 8 (e.g., side walls) are protected from a further removal of material in order to provide the anisotropic nature of the process as a whole.

Figure 5:
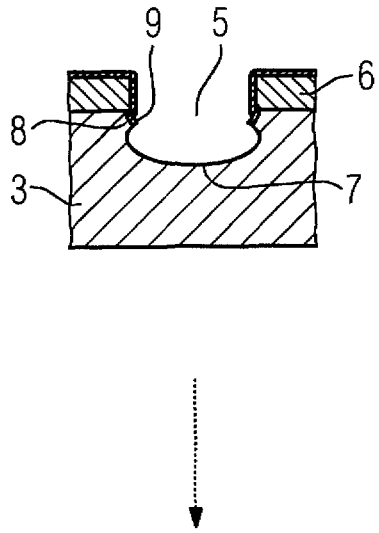

Through the ensuing repeated etching act, as shown in FIG. 5, passivation layer 9 on the floor 7 is removed significantly faster by the directed physical component (ions) of the etching reaction than passivation layer 9 on the side walls 8.

Figure 3:
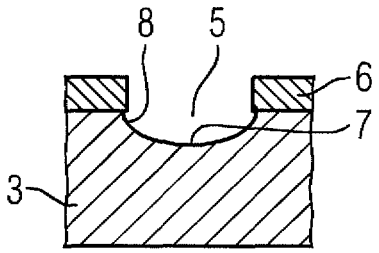
Figure 6:
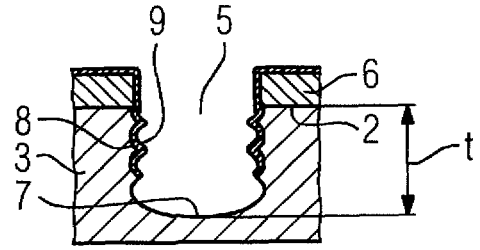

The acts according to FIG. 3 and FIG. 4 (or FIG. 5) continue being repeated until the desired depth t of the trench 5 has been attained, as shown in FIG. 6.

Figure 7:
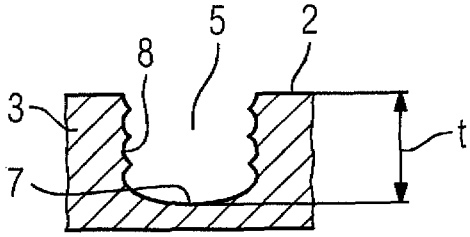

The material forming mask 6 and the passivation layer 9 on the side walls 8 are removed after etching, as shown in FIG. 7.

In contrast to when material is removed by a laser beam or water jet, the trenches 5 resulting from deep reactive ion etching (and microstructures in general) have, for example, a typical horizontal fluted or rippled form, as shown, for example, in FIG. 7, on the side walls 8. The fluting does not detract from the effectiveness of the trenches 5 for stress reducing.

The invention is not limited to the exemplary embodiment shown. A person skilled in the relevant art could deduce other variants without departing from the scope of protection of the invention.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A rotating anode comprising:

a focal track that has a microstructure on a surface of the focal track;

wherein the microstructure is produced by deep reactive ion etching, and wherein the microstructure comprises a fluted surface.

2. The rotating anode as claimed in claim 1, wherein the microstructure has a depth of at least approximately 40 micrometers.

3. The rotating anode as claimed in claim 2, wherein the depth is at least approximately 50 micrometers.

4. The rotating anode as claimed in claim 2, wherein the depth is up to approximately 150 micrometers.

5. The rotating anode as claimed in claim 4, wherein the depth is up to approximately 100 micrometers.

6. The rotating anode as claimed in claim 2, wherein the microstructure has at least one trench.

7. The rotating anode as claimed in claim 6, wherein the at least one trench comprises a plurality of trenches arranged in a lattice-like pattern, and wherein a ratio between a width of a trench of the plurality of trenches and a distance from an adjacent, substantially parallel trench of the plurality of trenches is at least 0.1.

8. The rotating anode as claimed in claim 1, wherein the microstructure has a width of between 2 micrometers and 15 micrometers.

9. The rotating anode as claimed in claim 8, wherein the width is between 3 micrometers and 10 micrometers.

10. The rotating anode as claimed in claim 9, wherein the width is between 5 micrometers and 10 micrometers.

11. The rotating anode as claimed in claim 8, wherein the focal track contains tungsten.

12. The rotating anode as claimed in claim 1, wherein the microstructure has at least one trench.

13. The rotating anode as claimed in claim 12, wherein the at least one trench comprises a plurality of trenches arranged in a lattice-like pattern.

14. The rotating anode as claimed in claim 13, wherein a distance between adjacent, substantially mutually parallel trenches of the plurality of trenches is between approximately 100 micrometers and 300 micrometers.

15. The rotating anode as claimed in claim 14, wherein a ratio between a width of a trench of the plurality of trenches and a distance from an adjacent, substantially parallel trench of the plurality of trenches is at least 0.1.

16. The rotating anode as claimed in claim 13, wherein a ratio between a width of a trench of the plurality of trenches and a distance from an adjacent, substantially parallel trench of the plurality of trenches is at least 0.1.

17. The rotating anode as claimed in claim 1, wherein the focal track contains tungsten.

18. An X-ray device comprising:

at least one rotating anode comprising:

a focal track that has a microstructure on a surface of the focal track;

wherein the microstructure is produced by deep reactive ion etching, and wherein the microstructure comprises a fluted surface.

19. The X-ray device of claim 18, wherein the X-ray device is for medical applications.

20. A method for producing a rotating anode, the method comprising:

deep reactive ion etching a microstructure in a surface of a focal track of the rotating anode; and forming a fluted surface in a side wall of the microstructure.

* * * * *